US008791863B2

(12) United States Patent
Seo et al.

(10) Patent No.: US 8,791,863 B2
(45) Date of Patent: Jul. 29, 2014

(54) BUILT-IN PRINTED CIRCUIT BOARD ANTENNA OF MOBILE TERMINAL

(75) Inventors: Jae Min Seo, Suwon-si (KR); Jae Sun Park, Suwon-si (KR); Kyung Jung Kim, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 298 days.

(21) Appl. No.: 12/881,630

(22) Filed: Sep. 14, 2010

(65) Prior Publication Data

US 2011/0122045 A1 May 26, 2011

(30) Foreign Application Priority Data

Nov. 23, 2009 (KR) ..... 10-2009-0113020

(51) Int. Cl.
*H01Q 1/24* (2006.01)
*H01Q 1/22* (2006.01)
*H01Q 1/38* (2006.01)

(52) U.S. Cl.
CPC ..... *H01Q 1/22* (2013.01); *H01Q 1/243* (2013.01); *H01Q 1/38* (2013.01)
USPC ..... 343/702

(58) Field of Classification Search
CPC ..... H01Q 1/22; H01Q 1/24; H01Q 1/241; H01Q 1/242; H01Q 1/243; H01Q 1/245; H01Q 1/38
USPC ..... 343/706, 700 MS, 702
See application file for complete search history.

(56) References Cited

U.S. PATENT DOCUMENTS

| | | | | |
|---|---|---|---|---|
| 6,204,817 | B1 * | 3/2001 | Edvardsson | 343/702 |
| 6,239,765 | B1 * | 5/2001 | Johnson et al. | 343/795 |
| 6,404,394 | B1 * | 6/2002 | Hill | 343/702 |
| 6,426,724 | B2 * | 7/2002 | Gunee et al. | 343/702 |
| 6,466,176 | B1 * | 10/2002 | Maoz et al. | 343/767 |
| 6,570,538 | B2 * | 5/2003 | Vaisanen et al. | 343/702 |
| 6,603,430 | B1 * | 8/2003 | Hill et al. | 343/702 |
| 6,882,319 | B2 * | 4/2005 | Jinushi | 343/702 |
| 7,728,785 | B2 * | 6/2010 | Ozden | 343/866 |
| 2008/0180333 | A1 * | 7/2008 | Martiskainen et al. | 343/722 |

FOREIGN PATENT DOCUMENTS

KR 10-0602710 B1 7/2006

* cited by examiner

*Primary Examiner* — Hoang V Nguyen
*Assistant Examiner* — Patrick Holecek
(74) *Attorney, Agent, or Firm* — Jefferson IP Law, LLP

(57) ABSTRACT

A built-in Printed Circuit Board (PCB) antenna of a mobile terminal is erected to guarantee a sufficient distance from a human body. The built-in PCB antenna includes a main PCB having a power feeding line and a first antenna pattern having a power feeding antenna line having an end electrically connected to the power feeding line, through-holes formed at an end of the main PCB and having a conduction hole electrically connected to the first antenna pattern, an erected PCB fixed on the main PCB orthogonally and having a second antenna pattern formed thereon, and protrusions formed at a lateral side of the erected PCB and having a conduction protrusion, inserted into the conduction hole, electrically connected to an end of the second antenna pattern. The built-in PCB antenna may reduce deterioration of radiation performance caused by a body of a user.

13 Claims, 6 Drawing Sheets

BUILT-IN PRINTED CIRCUIT BOARD ANTENNA OF MOBILE TERMINAL

PRIORITY

This application claims the benefit under 35 U.S.C. §119 (a) of a Korean patent application filed on Nov. 23, 2009 in the Korean Intellectual Property Office and assigned Serial No. 10-2009-0113020, the entire disclosure of which is hereby incorporated by reference.

BACKGROUND OF THE INVENTION

1. Field of the Invention

The present invention relates to a built-in Printed Circuit Board (PCB) antenna of a mobile terminal. More particularly, the present invention relates to a built-in PCB antenna of a mobile terminal erected at a right angle for guaranteeing a minimum distance from a human body.

2. Description of the Related Art

Mobile terminals are available in a wide range of costs, from expensive to very inexpensive. The very inexpensive mobile terminals are becoming popular in developing countries. For this reason, Printed Circuit Board (PCB) antennas, in which antenna patterns are formed directly on a main PCB, are frequently used instead of a carrier antenna.

FIG. 1 is a perspective view illustrating a built-in PCB antenna of a mobile terminal of a related art. As illustrated in FIG. 1, the built-in PCB antenna 11 includes a main PCB 10, a power feeding line 13 formed on the main PCB 10, and an antenna pattern 15 formed on the main PCB 10 and electrically connected to the power feeding line 13.

In the built-in PCB antenna of a mobile terminal of the related art, because a distance between the antenna and a head of a user is shorter than a corresponding distance with the carrier antenna, radiation performance of the antenna is often deteriorated.

SUMMARY OF THE INVENTION

An aspect of the present invention is to address the above-mentioned problem and/or disadvantages and to provide at least the advantages described below. Accordingly, an aspect of the present invention is to provide a built-in Printed Circuit Board (PCB) antenna of a mobile terminal to reduce deterioration of radiation performance caused by a human body.

In accordance with an aspect of the present invention, a built-in PCB antenna of a mobile terminal is provided. The built-in PCB includes: a main PCB including a power feeding line and a first antenna pattern having at least one power feeding antenna line, an end of which is electrically connected to the power feeding line, a plurality of through-holes formed at an end of the main PCB and including at least one conduction hole to which an end of the first antenna pattern is electrically connected, an erected PCB fixed on the main PCB orthogonally and including a second antenna pattern formed thereon, and a plurality of protrusions formed at a lateral side of the erected PCB and including at least one conduction protrusion, inserted into the at least one conduction hole to which an end of the second antenna pattern is electrically connected.

According to the built-in PCB antenna of the present invention, the erected PCB formed with the antenna pattern is formed at an end of the main PCB orthogonally so that deterioration of radiation performance caused by a body of a user can be reduced. A sufficient distance from the second antenna pattern to the human body is guaranteed so that absorption of electromagnetic waves by the human body may be reduced.

Moreover, in the PCB antenna of the related art, a surface opposite to a surface on which the antenna pattern is formed needs a necessary non-ground region for preventing radiation from the antenna from being disturbed. Metal such as a key dome cannot be installed in the necessary non-ground region. However, in the built-in PCB antenna of exemplary embodiments of the present invention, because the second antenna pattern is formed on the erected PCB, the necessary non-ground region is reduced so that an area in which the metal parts are installed is widened.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
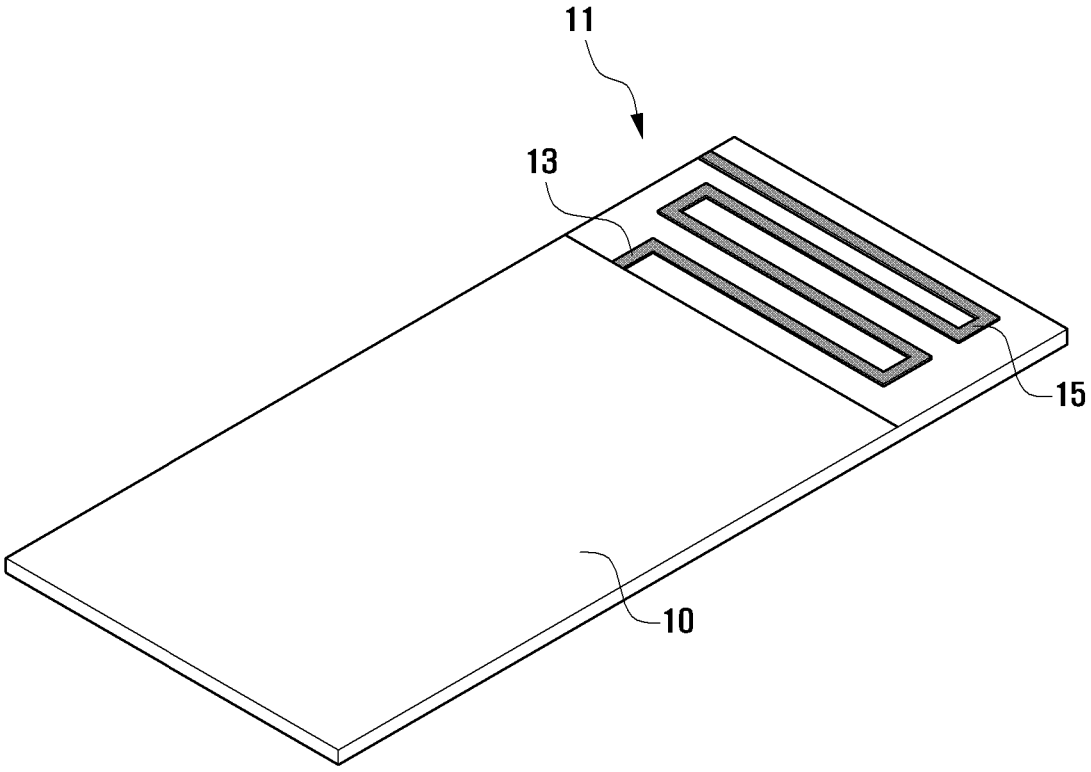
FIG. 1 RELATED ART
FIG. 1 is a perspective view illustrating a built-in Printed Circuit Board (PCB) antenna of a mobile terminal of a related art.
Figure 2:
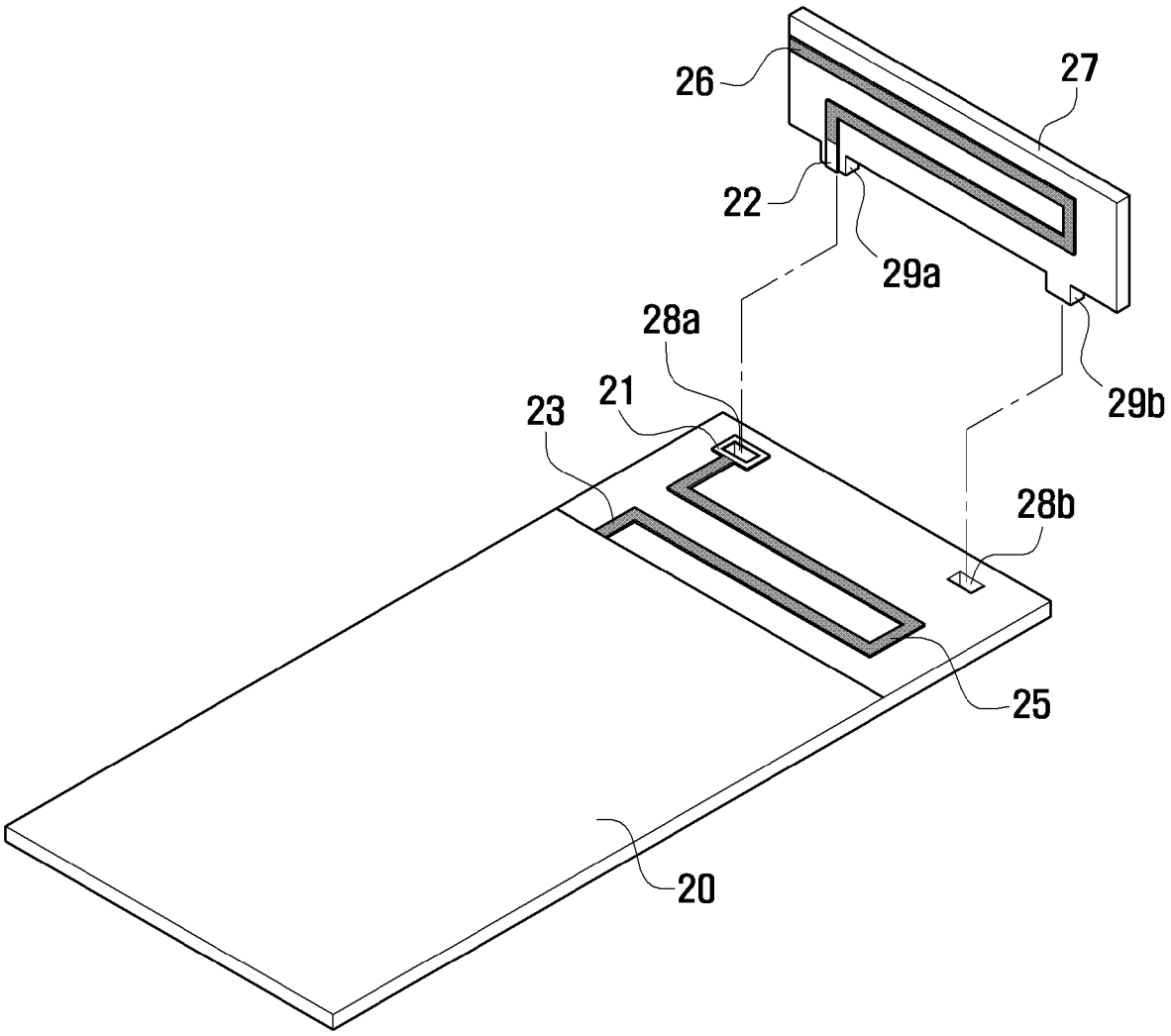
FIG. 2 is an exploded perspective view illustrating a built-in PCB antenna of a mobile terminal according to an exemplary embodiment of the present invention.
Figure 3:
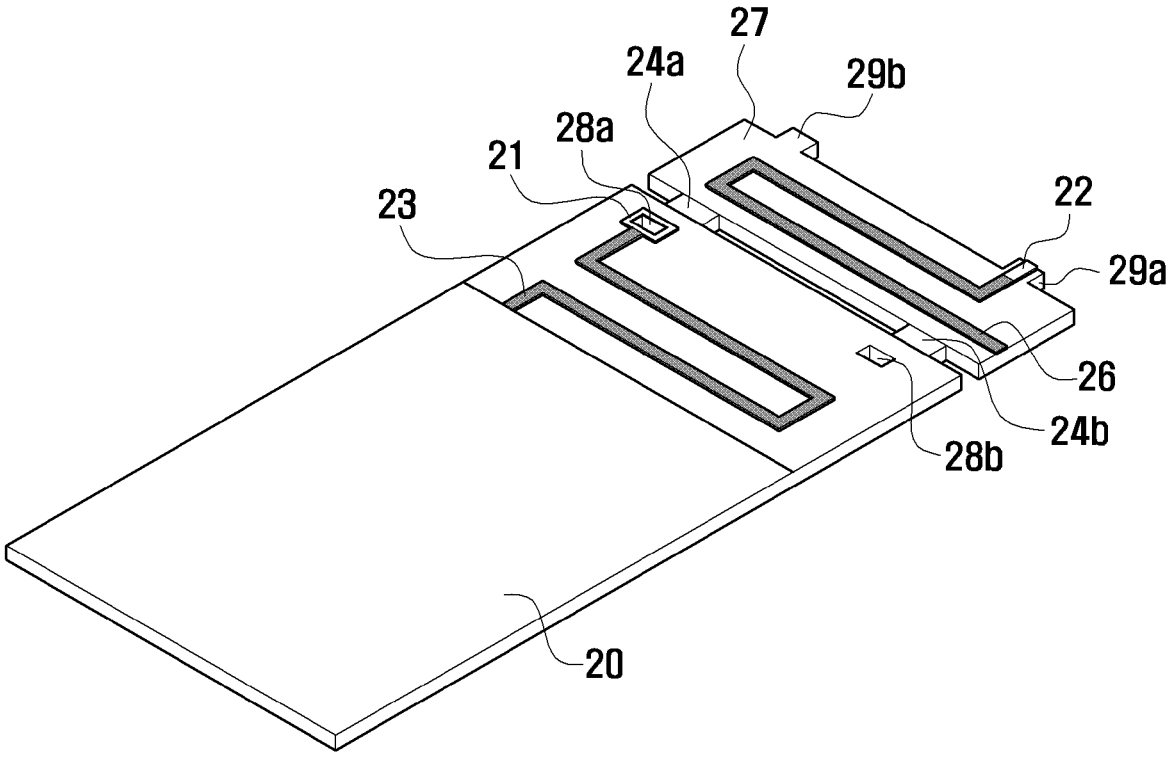
FIG. 3 is a perspective view illustrating a main PCB and an erected PCB before separation during manufacturing of the built-in PCB antenna of a mobile terminal according to an exemplary embodiment of the present invention.
Figure 4:
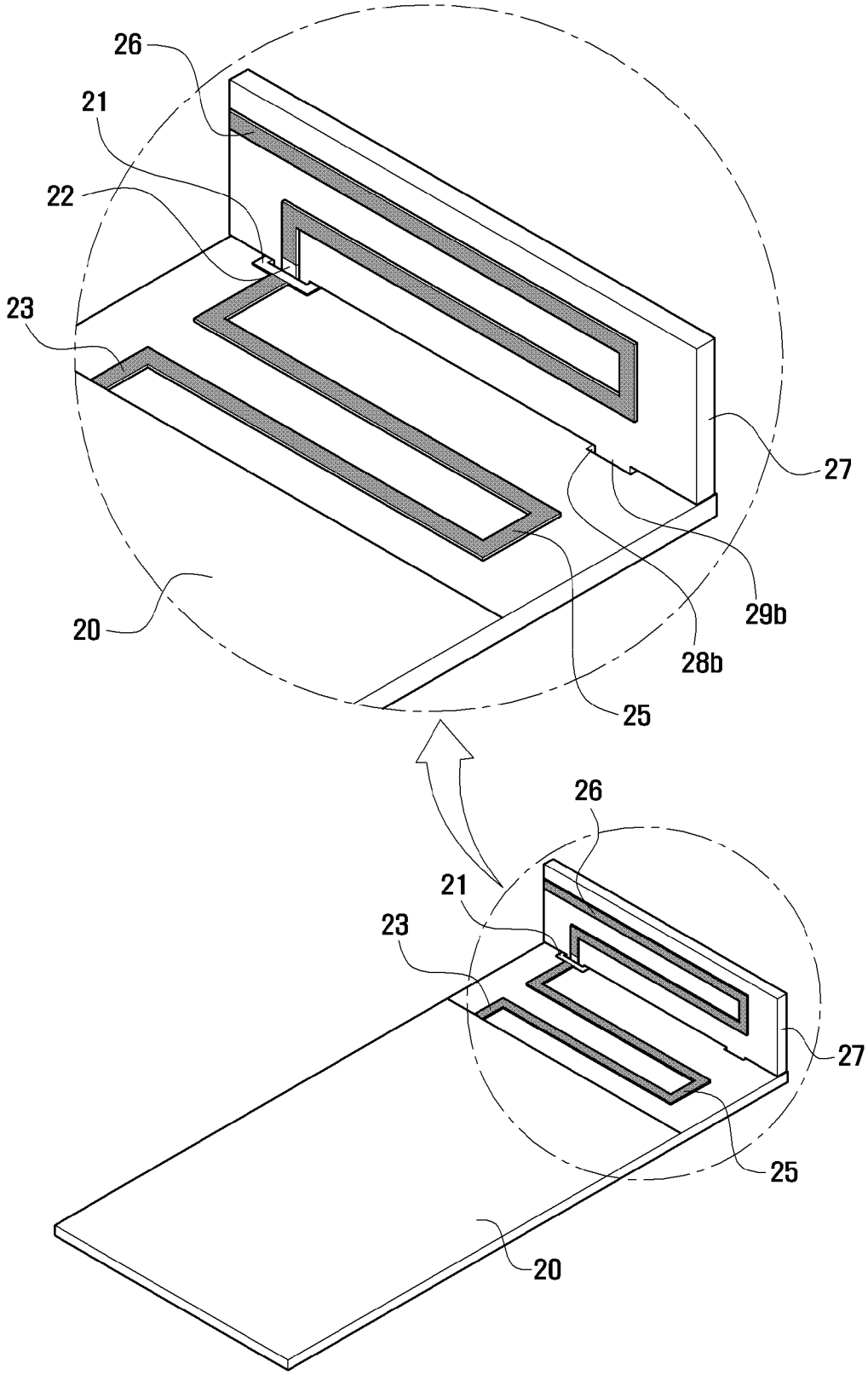
FIG. 4 is a perspective view illustrating an assembly of the main PCB and the erected PCB of the built-in PCB antenna of a mobile terminal as illustrated in FIG. 2 according to an exemplary embodiment of the present invention.

FIG. 2 is an exploded perspective view illustrating a built-in Printed Circuit Board (PCB) antenna of a mobile terminal according to an exemplary embodiment of the present invention. FIG. 3 is a perspective view illustrating a main PCB and an erected PCB before separation during manufacturing of the built-in PCB antenna of a mobile terminal according to an exemplary embodiment of the present invention. FIG. 4 is a perspective view illustrating an assembly of the main PCB and the erected PCB of the built-in PCB antenna of a mobile terminal as illustrated in FIG. 2.

Referring to FIGS. 2 and 4, a built-in PCB antenna of a mobile terminal according to an exemplary embodiment of the present invention will be described as follows. The built-in PCB antenna of a mobile terminal according to an exemplary embodiment of the present invention may include a main PCB 20, two through-holes 28*a* and 28*b*, an erected PCB 27, and two protrusions 29*a* and 29*b*.

A power feeding line 23 and a first antenna pattern 25 are formed on the main PCB 20, wherein the first antenna pattern 25 has a single power feeding antenna line that is electrically connected to the power feeding line 23. The first antenna pattern 25 has a meander line shape.

The two through-holes 28*a* and 28*b* are formed at an end portion of the main PCB 20 in alignment. The through-holes 28*a* and 28*b* are a conduction hole 28*a* and a fixing hole 28, respectively. The conduction hole 28*a* has a conduction layer 21 formed on an inner surface and on an upper circumference thereof. An end of the first antenna pattern 25 is electrically connected to the conduction layer.

Next, the erected PCB 27 will be described. The erected PCB 27 includes a meander line shaped second antenna pattern 26 formed thereon. The erected PCB 27 includes two protrusions 29*a* and 29*b* formed on a lateral side. The protrusions 29*a* and 29*b* are a conduction protrusion 29*a* and a fixing protrusion 29*b*. The conduction protrusion 29*a* includes a conduction layer 22 which is formed on the conduction protrusion 29*a* and which is electrically connected to an end of the second antenna pattern 26.

Referring to FIG. 3, manufacturing of the built-in PCB antenna of a mobile terminal according to the exemplary embodiment of the present invention will be described partially as follows. As illustrated in FIG. 3, the main PCB 20 having the first antenna pattern 23 and the erected PCB 27 having the second antenna pattern 26 are connected to each other in a plane by a plurality of bridges 24*a* and 24*b*. The two protrusions 29*a* and 29*b* are positioned at an opposite side of the bridges 24*a* and 24*b*. When the bridges 24*a* and 24*b* are cut away in the state as illustrated in FIG. 3, the erected PCB 27 is separated from the main PCB 20 and the erected PCB 27 may be electrically connected to the main PCB 20 as described later.

Referring to FIG. 4, when the conduction protrusion 29*a* and the fixing protrusion 29*b* of the erected PCB 27 are inserted into the conduction hole 28*a* and the fixing hole 28*a*, the conduction layer 22 of the conduction protrusion 29*a* contacts the conduction layer 21 of the conduction hole 28*a*. The contact may be secured by soldering. By doing so, the first antenna pattern 25 is electrically connected to the second antenna pattern 26 to serve as a single band antenna.

The built-in PCB antenna of a mobile terminal according to the exemplary embodiment of the present invention as illustrated in FIG. 4 is a monopole antenna type single band antenna without a ground line, but alternatively may be a Planar Inverted-F Antenna (PIFA) type single band antenna to which a ground line is connected at the power feeding line. When the built-in PCB antenna according to the exemplary embodiment of the present invention is a PIFA antenna, the built-in PCB antenna may be remarkably reduced in size even in use at the same frequency band as a frequency band of the monopole antenna type single band antenna without a ground line.

In the built-in PCB antenna of a mobile terminal according to an exemplary embodiment of the present invention, differently from the built-in PCB antenna of the related art, a part of an end portion of the main PCB in which the antenna pattern is formed is erected from the main PCB. Thus, since a distance from the antenna pattern of the erected PCB to a head of a user is longer than a distance from the antenna pattern of the built-in PCB antenna of the related art to the head of a user, deterioration of radiation performance caused by the body of a user may be reduced. A minimum distance is guaranteed so that absorption of electromagnetic waves into a human body can be reduced.

The erected PCB of the built-in PCB antenna of a mobile terminal according to this exemplary embodiment of the present invention has a thickness of 0.5 mm to 1.6 mm and the carrier antenna of the related art has a minimum thickness of 5 mm. Thus, the built-in PCB antenna of a mobile terminal according to this exemplary embodiment of the present invention needs less material costs than are needed for the carrier antenna of the related art, and a space in which the built-in PCB antenna is installed may be more fully utilized.

Figure 5:
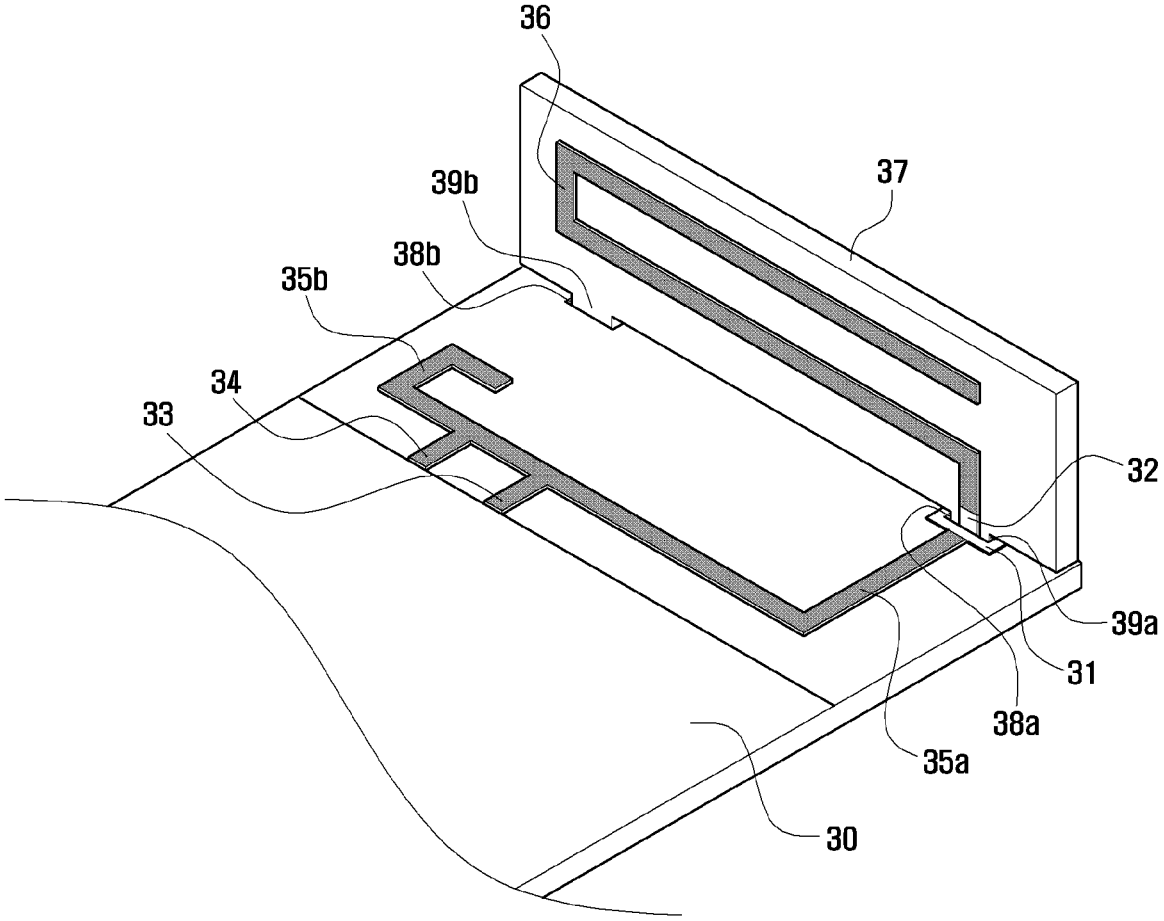
FIG. 5 is a perspective view illustrating a built-in PCB antenna of a mobile terminal according to an exemplary embodiment of the present invention.

FIG. 5 is a perspective view illustrating a built-in PCB antenna of a mobile terminal according to an exemplary embodiment of the present invention. A built-in PCB antenna of a mobile terminal according to an exemplary embodiment of the present invention will be described with reference to FIG. 5 as follows. The built-in PCB antenna of a mobile terminal according to an exemplary embodiment of the present invention includes a main PCB 30, two through-holes 38*a* and 38*b*, an erected PCB 37, and two protrusions 39*a* and 39*b*.

The main PCB 30 includes a power feeding line 33 and first antenna patterns 35*a* and 35*b* electrically connected to the power feeding line 33, which are formed on the main PCB 30. The first antenna patterns 35*a* and 35*b* include a first power feeding antenna line 35*a* electrically connected to the power feeding line 33 and a second power feeding antenna line 35*b* having an end electrically connected to the power feeding line 33 and an opposite open end. A ground line 34 is electrically connected to a portion near to the power feeding line 33 of the second power feeding antenna line 35*b*.

The main PCB 30 includes two through-holes 38*a* and 38*b* formed at an end portion in alignment. The through-holes 38*a* and 38*b* are a conduction through-hole 38*a* and a fixing through-hole 38*b*. The conduction through-hole 38*a* has a conduction layer 31, coated on an inner surface and on an outer circumference, to which the opposite end of the first power feeding antenna line 35*a* is electrically connected.

Next, the erected PCB 37 will be described. The erected PCB 37 includes a meander line shaped second antenna pattern 36 formed thereon. The erected PCB 37 includes two protrusions 39*a* and 39*b* formed on a lateral side. The protrusions 39*a* and 39*b* are a conduction protrusion 39*a* and a fixing protrusion 39*b*. The conduction protrusion 39*a* includes a conduction layer 32 which is formed on the conduction protrusion 39*a* and which is electrically connected to an end of the second antenna pattern 36. Moreover, as in the previous exemplary embodiment of the present invention, the conduction layers 31 and 32 contact each other when the conduction protrusion 39*a* is inserted into the conduction hole 38*b*. The contact may be secured by soldering.

With the above-mentioned configuration, the built-in PCB antenna of a mobile terminal according to an exemplary embodiment of the present invention serves as a dual band antenna having a low band antenna formed by the first power feeding antenna line 35*a* and the second antenna pattern 36 and a high band antenna formed by the second power feeding antenna line 35*b*.

The second power feeding antenna line 35*b* of the built-in PCB antenna of a mobile terminal according to an exemplary embodiment of the present invention is a PIFA antenna having a ground line 34, but alternatively may be a monopole antenna without a ground line. In the previous and present exemplary embodiments of the present invention, the number of the described fixing holes and fixing protrusions is one each respectively, but alternatively, more fixing holes and fixing protrusions may be formed in alignment with other through-holes and other protrusions.

Figure 6:
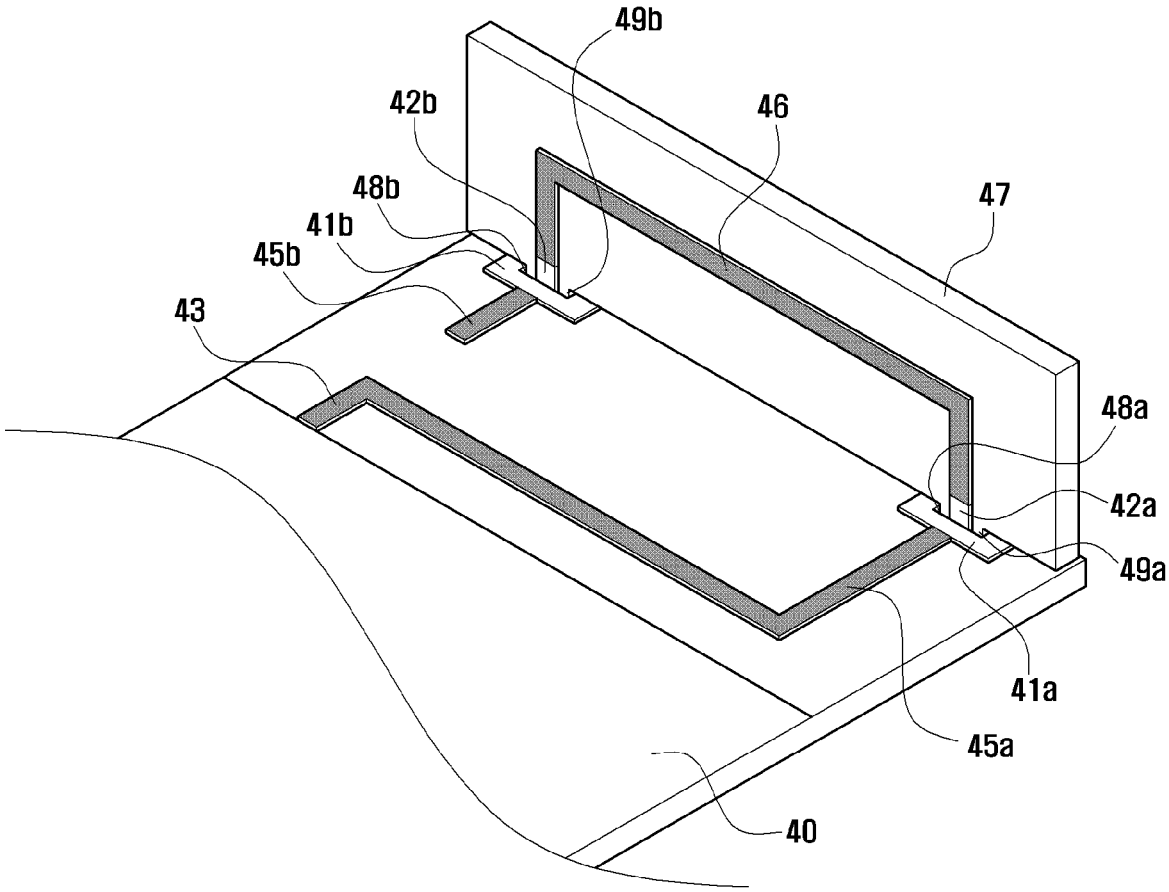
FIG. 6 is a perspective view illustrating a built-in PCB antenna of a mobile terminal according to an exemplary embodiment of the present invention.

FIG. 6 is a perspective view illustrating a built-in PCB antenna of a mobile terminal according to an exemplary embodiment of the present invention. A built-in PCB antenna of a mobile terminal according to an exemplary embodiment of the present invention will be described with reference to FIG. 6 as follows. The built-in PCB antenna of a mobile terminal according to an exemplary embodiment of the present invention includes a main PCB 40, two through-holes 48*a* and 48*b*, an erected PCB 47, and two protrusions 49*a* and 49*b*.

The main PCB 40 includes a power feeding line 43 and first antenna patterns 45*a* and 45*b* which are a power feeding line 45*a* and a non-power feeding line 45*b* and which are formed on the main PCB 30. The power feeding antenna line 45*a* is electrically connected to the power feeding line 43. The non-power feeding line 45*b* is separated from the power feeding line 45*a* and has an open end. The power feeding antenna line 45*a* has a meander line shape.

The main PCB 40 includes two through-holes 48*a* and 48*b* formed at an end portion in alignment. The through-holes 48*a* and 48*b* have a first conduction through-hole 48*a* and a second conduction through-hole 48*b*. The first and second conduction through-holes 48*a* and 48*b* have a first conduction layer 41*a* and a second conduction layer 41*b*, coated both on inner surfaces and on outer circumferences thereof respectively. The opposite end of the first power feeding antenna line 45*a* is electrically connected to the first conduction layer 41*a* and the opposite end of the non-power feeding antenna line 45*b* is electrically connected to the second conduction layer 41*b*.

Next, the erected PCB 47 will be described. The erected PCB 47 includes a meander line shaped second antenna pattern 46 formed thereon. The erected PCB 47 includes two protrusions 49*a* and 49*b* formed on a lateral side. The protrusions 49*a* and 49*b* are a first conduction protrusion 49*a* and a second conduction protrusion 49*b*. The first and second conduction protrusions 49*a* and 49*b* include a first conduction layer 42*a* and a second conduction layer 42*b* formed on the conduction protrusions 49*a* and 49*b*. An end of the second antenna pattern 46 is electrically connected to the first conduction layer 42*a* and the opposite end thereof is electrically connected to the second conduction layer 42*b*.

Referring to FIG. 6, when the first conduction protrusion 49*a* and the second conduction protrusion 49*b* are inserted into the first conduction hole 48*a* and the second conduction hole 48*b* respectively, the first conduction layer 42*a* of the first conduction protrusion 49*a* and the second conduction layer 42*b* of the second conduction protrusion 49*b* contact the first conduction layer 41*a* of the first conduction hole 48*a* and the second conduction layer 41*b* of the second conduction hole 48*b* respectively. The contact may be secured by soldering. By doing so, the power feeding antenna line 45*a*, the second antenna pattern 46, and the non-power feeding antenna line 45*b* are electrically connected sequentially to form an antenna pattern.

Although there are no fixing protrusion and fixing hole described in this exemplary embodiment of the present invention, a fixing protrusion and fixing hole may be formed in alignment with other protrusions and other through-holes.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A printed circuit board antenna for a mobile terminal, the printed circuit board antenna comprising:

a main printed circuit board including a power feeding line and a first antenna pattern comprising at least one power feeding antenna line, an end of which is electrically connected to the power feeding line;

a plurality of through-holes formed at an end of the main printed circuit board and including at least one conduction hole to which an end of the first antenna pattern is electrically connected;

an erected printed circuit board fixed on the main printed circuit board orthogonally and including a second antenna pattern formed thereon; and a plurality of protrusions formed at a lateral side of the erected printed circuit board and including at least one conduction protrusion, inserted into the at least one conduction hole, to which an end of the second antenna pattern is electrically connected, wherein the power feeding antenna line comprises a first power feeding antenna line and a second power feeding antenna line, wherein the second power feeding antenna line is disposed only on the main printed circuit board and is electrically and directly connected to a ground line to implement a Planar Inverted F Antenna (PIFA), wherein the first power feeding antenna line and the second power feeding antenna line are directly connected to the power feeding line, and wherein the first power feeding antenna line and the second antenna pattern together form a low band antenna, and the second power feeding antenna line forms a high band antenna.

2. The printed circuit board antenna of claim 1, wherein the plurality of through-holes comprises:

at least one conduction hole; and at least one fixing hole formed at an end of the printed circuit board in alignment with the at least one conduction hole.

3. The printed circuit board antenna of claim 2, wherein the plurality of protrusions comprises:

the at least one conduction protrusion; and at least one fixing protrusion formed at a lateral side of the erected printed circuit board and inserted into the at least one fixing hole.

4. The printed circuit board antenna of claim 1, wherein the second antenna pattern comprises a meander line comprising an end electrically connected to the at least one conduction protrusion.

5. The printed circuit board antenna of claim 1, wherein the first power feeding antenna line comprises a meander line comprising an end electrically connected to the power feeding line and an opposite end electrically connected to the at least one conduction hole.

6. The printed circuit board antenna of claim 1, wherein the second power feeding antenna line comprises a meander line comprising an end electrically connected to the power feeding line and an opposite open end.

7. The printed circuit board antenna of claim 1, wherein the at least one conduction hole comprises a first conduction hole and a second conduction hole, and wherein the at least one conduction protrusion comprises a first conduction protrusion and a second conduction protrusion.

8. The printed circuit board antenna of claim 7, wherein the first conduction protrusion is electrically connected to an end of the second antenna pattern and the second conduction protrusion is electrically connected to an opposite end of the second antenna pattern.

9. The printed circuit board antenna of claim 7, wherein the first conduction hole is electrically connected to an opposite end of the power feeding antenna line.

10. The printed circuit board antenna of claim 7, the main printed circuit board further comprising: a non-power feeding antenna line comprising an open end and separated from the power feeding line and from the power feeding antenna line, wherein the second conduction hole is electrically connected to an opposite end of the non-power feeding antenna line.

11. The printed circuit board antenna of claim 1, wherein the main printed circuit board comprises a plurality of surfaces, and wherein the erected printed circuit board is fixed on a surface of the main printed circuit board that is farther in normal use from a user of the mobile terminal.

12. The printed circuit board antenna of claim 11, wherein the second antenna pattern on the erected printed circuit board is located at least a predetermined distance in normal use from the user of the mobile terminal.

13. The printed circuit board antenna of claim 12, wherein the predetermined distance is greater than a distance of the main printed circuit board in normal use from the user of the mobile terminal.

* * * * *